US009623552B2

(12) United States Patent
Stoklosa et al.

(10) Patent No.: US 9,623,552 B2
(45) Date of Patent: Apr. 18, 2017

(54) MARKING SYSTEM USING GRAVITY

(71) Applicants: Anna Stoklosa, Maple (CA); Franciszek Stoklosa, Maple (CA)

(72) Inventors: Anna Stoklosa, Maple (CA); Franciszek Stoklosa, Maple (CA)

( * ) Notice: Subject to any disclaimer, the term of this patent is extended or adjusted under 35 U.S.C. 154(b) by 111 days.

(21) Appl. No.: 14/531,100

(22) Filed: Nov. 3, 2014

(65) Prior Publication Data

US 2015/0183110 A1 Jul. 2, 2015

(30) Foreign Application Priority Data

Nov. 12, 2013 (CA) ..... 2832558

(51) Int. Cl.

| | |
|---|---|
| ***B25H 7/04*** | (2006.01) |
| ***B43L 13/00*** | (2006.01) |
| ***B43K 17/00*** | (2006.01) |
| ***B43K 23/00*** | (2006.01) |

(52) U.S. Cl.

CPC ..... *B25H 7/045* (2013.01); *B43K 17/005* (2013.01); *B43K 23/001* (2013.01); *B43L 13/00* (2013.01)

(58) Field of Classification Search

CPC .... B43K 23/001; B43K 17/008; B25H 7/045; B25H 7/04; B25H 7/02; E04F 21/0076

USPC ..... 33/577, 18.1–45, 666, DIG. 20

See application file for complete search history.

(56) References Cited

U.S. PATENT DOCUMENTS

| | | | | | |
|---|---|---|---|---|---|
| 1,005,827 | A * | 10/1911 | Pulver | B43L 9/04 | 33/27.03 |
| 1,927,992 | A * | 9/1933 | Pulver | G01C 15/00 | 138/45 |
| 2,428,213 | A * | 9/1947 | Gloede | B44D 3/225 | 33/41.1 |
| 3,491,448 | A * | 1/1970 | Quinton | B43L 7/005 | 33/27.01 |
| 4,222,171 | A * | 9/1980 | Malacheski | B43L 9/00 | 33/26 |
| 4,616,418 | A * | 10/1986 | Wade, III | B43L 9/04 | 33/27.01 |
| 5,183,373 | A * | 2/1993 | Floyd, Jr. | B23Q 1/4804 | 144/144.51 |
| 6,804,890 | B1 * | 10/2004 | Kennedy, Sr. | B43L 13/007 | 33/21.3 |
| 6,804,898 | B1 * | 10/2004 | Hsu | B43K 8/003 | 33/668 |
| 6,907,669 | B1 * | 6/2005 | Han | B43K 29/001 | 33/27.03 |
| 8,127,457 | B2 * | 3/2012 | Stoklosa | B25H 7/04 | 33/32.2 |

* cited by examiner

*Primary Examiner* — Joshua Kennedy

(57) ABSTRACT

The present invention pertains generally to marking surfaces by using gravity system and marking object that is being placed in a marking tube and allowing by its gravity to touch the surface, predominantly to mark the surface. The marking tube is adjustable allowing the marking object to touch the surface accordingly; the marking tube is located on a supporting guide. Particularly, the present invention should and/or will be useful for marking any flooring surfaces and/or any other surfaces where applicable.

3 Claims, 3 Drawing Sheets

Figure 1:
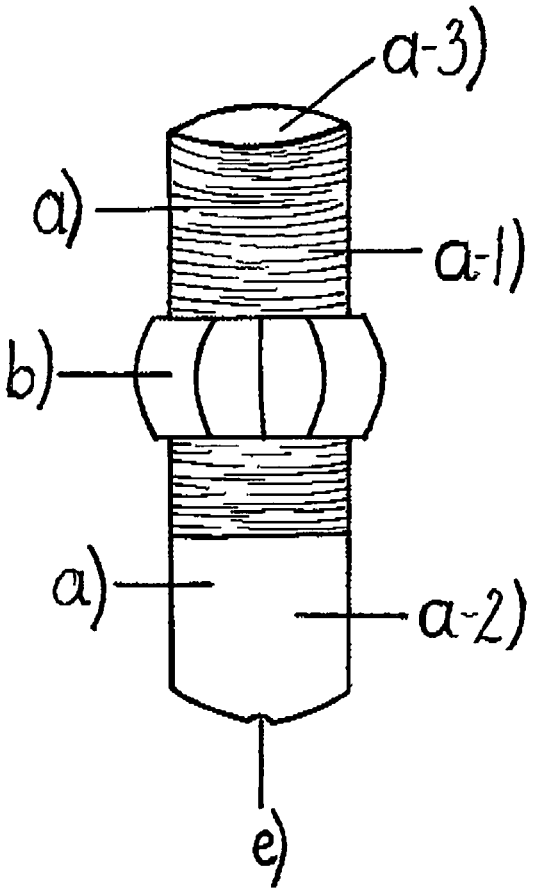

Figure 2.1
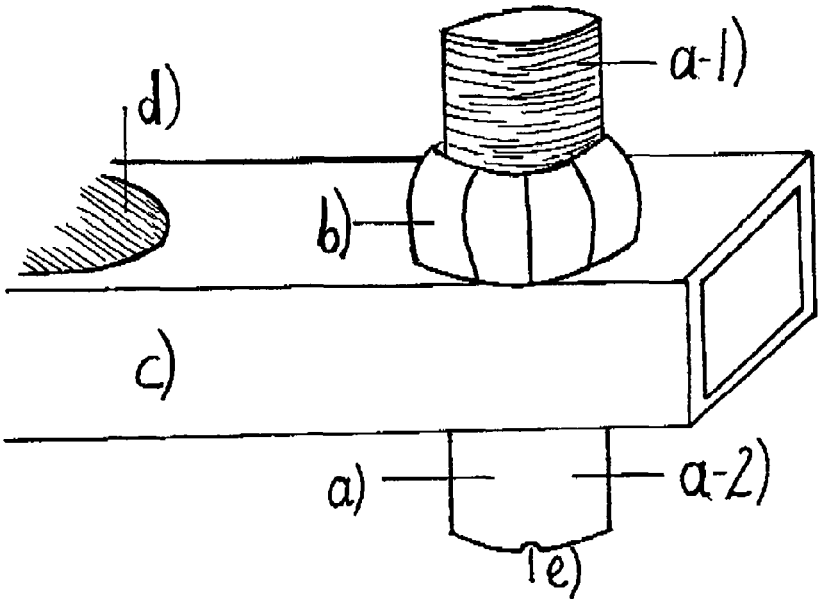
Figure 2.2
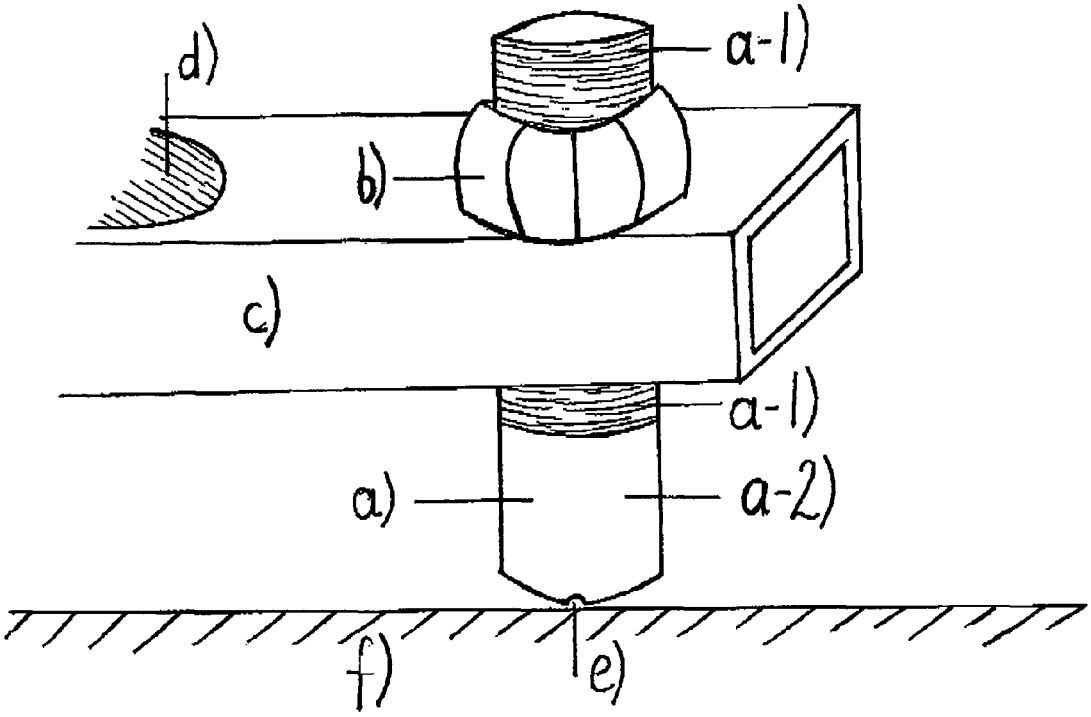

MARKING SYSTEM USING GRAVITY

FIELD OF THE INVENTION

The present invention pertains generally to marking surfaces by using gravity system and marking object. Particularly, the present invention relates to TOOL, METHOD AND MARKING SYSTEM of Canadian Patent No. 2,625,566, U.S. Pat. No. 8,127,457 B2, and can be used as said or with other devices to mark any surfaces where applicable.

BACKGROUND OF THE INVENTION

In the field of marking and tracing surfaces we see many innovations that are patented and in use. Although, many ways are registered with office and tested by engineers, there are more ways to simplify the marking system. The MARKING SYSTEM USING GRAVITY has been engineered to suit a particular invention with marking/tracing contour system for a TOOL, METHOD AND MARKING SYSTEM of Canadian Patent No. 2,625,566, U.S. Pat. No. 8,127,457 B2, but can be used with other devices. For a perfect performance of marking by using pen or marker, while marking on any type of surface, the ideal marking system had to be engineered. This simple but innovative gravity structure works perfectly with the TOOL, METHOD AND MARKING SYSTEM of Canadian Patent No 2,625,566, U.S. Pat. No. 8,127,457 B2, but can be used with other devices.

The marking system encompasses a marking tube that is adjustable and of a specific weight to work with gravity. The marking tube is situated in the hole of a supporting guide. The marking tube is in shape of a tube where the bottom is closed leaving little space for a tip of a pen or marker to go through and the top is fully open to input the marker/pen. The marking tube is in similar visual orientation as a screw with nut. The nut adjusts the distance of the tube from the surface. Well adjusted marking tube with its gravity can allow marker or pen that is inside of marking tube, mark on even surfaces and on uneven surfaces. When working on uneven surface, the marker/pen will touch the surface letting the marking tube move up and down accordingly.

The background of marking instruments shows that most of them were used with springs to adjust the distance, while this invention is simply using its gravitational weight. Currently there is no device that with such simplicity will allow marking on even and uneven surface while not touching the pen or marker by hand and specifically for use with TOOL, METHOD AND MARKING SYSTEM of Canadian Patent No. 2,625,566, U.S. Pat. No. 8,127,457 B2, and can be used in composition of any other device.

The present invention pertains generally to marking surfaces by using gravity system and marking object that is being placed in a marking tube and allowing by its gravity to touch the surface, predominantly to mark the surface. The marking tube is adjustable allowing the marking object to touch the surface accordingly; the marking tube is located throughout the supporting guide. Particularly, the present invention should and/or will be useful for marking any flooring surfaces and/or any other surfaces where applicable.

SUMMARY OF THE INVENTION

The present invention provides a system that allows marking surfaces by using simple method of gravity, marking tube and adjustments when marking. The marking tube is adjustable allowing the marking object to touch the surface accordingly; the marking tube is located throughout the supporting guide and the adjustment part is located on the outside side of the marking tube to adjust to the required position. Particularly, the present invention is engineered to work perfectly with the TOOL, METHOD AND MARKING SYSTEM of Canadian Patent No. 2,625,566, U.S. Pat. No. 8,127,457 B2, and also can be used to other devices that mark accordingly.

Operating the MARKING SYSTEM USING GRAVITY, on surfaces will allow the user/performer to easily mark the surface:

- Specifically with the use of the invention: TOOL, METHOD AND MARKING SYSTEM of Canadian Patent No. 2,625,566, U.S. Pat. No. 8,127,457 B2;
- Easy, simple system that can be used with other devices;
- Gravity system that allows to mark the surface by using a regular pen or marker;
- Gravity system that is adjusted to allow marking the uneven surface;

DETAILED DESCRIPTION OF DRAWINGS

Features and advantages of the present invention can be understood in detail; a more particular description of the invention, briefly summarized beneath, may and will reference to the embodiments thereof that are illustrated in the appended drawings. It is to be noted, however, that the appended drawings illustrate the typical embodiments of this invention and are, therefore, not to be considered limiting of its scope, for the invention may admit to other equally effective embodiments.

FIG. 1 Represents the MARKING SYSTEM USING GRAVITY, as a composition comprised of marking tube (pen/marker holder) with nut:

a) marking/pen holder tube
a-1) threaded surface
a-2) smooth surface
a-3) marking/pen holder opening for pen/marker
b) nut/screw nut
e) marker tip hole.

FIG. 2.1 Represents the MARKING SYSTEM USING GRAVITY, as composition comprised of marking pen/marker holder tube with nut, the supporting guide, in a higher positioned of marking/pen holder tube;

a) marking/pen holder tube
a-1) threaded surface
a-2) smooth surface
b) nut/screw nut
c) supporting guide
d) supporting guide hole
e) marker tip hole.

FIG. 2.2 Represents the MARKING SYSTEM USING GRAVITY, as composition comprised of marking pen/marker holder tube with nut, the supporting guide, in a lower positioned of marking/pen holder tube;

a) marking/pen holder tube
a-1) threaded surface
a-2) smooth surface
b) nut/screw nut
c) supporting guide
d) supporting guide hole
e) marker tip hole
f) surface.

Figure 3:
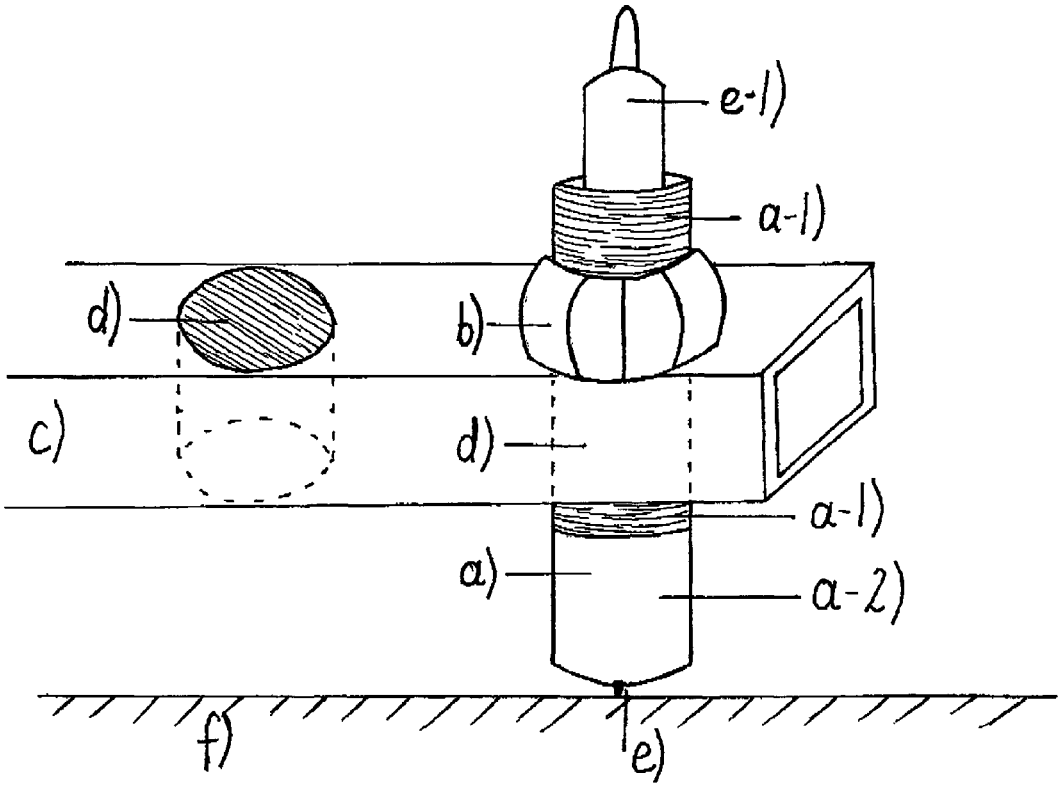

FIG. 3 Represents the MARKING SYSTEM USING GRAVITY, as a complete composition comprised of marking pen/marker holder tube with nut, the supporting guide, the pen/marker, surface;

a) marking/pen holder tube
a-1) threaded surface
a-2) smooth surface
b) nut/screw nut
c) supporting guide
d) supporting guide hole
e) marker tip hole
e-1) ejectable marker/pen
f) surface.

DETAILED DESCRIPTION OF THE INVENTION

Before explaining the present invention in details, it is to be understood that the invention is not limited to its application to the details of construction and arrangement of parts illustrated in the accompanying drawings. Moreover, it is to be understood that the phraseology and terminology employed herein is for the purpose of description and not of limitation.

In accordance with the present invention, and referring to FIG. 3, the composition comprises the complete invention, ready to be used when mounted to any marking device and particularly to a device of TOOL. METHOD AND MARKING SYSTEM of Canadian Patent No. 2,625,566, U.S. Pat. No. 8,127,457 B2; wherein the complete invention comprises: marking/pen holder tube (FIG. 3*a*); nut/screw nut (FIG. 3*b*); supporting guide (FIG. 3*c*); supporting guide hole (FIG. 3*d*); rejectable marker/pen (FIG. 3*e*-1); surface (FIG. 3*f*).

Referring to FIG. 1, wherein the said marking holder is made from heavier material (metal, aluminum, fiber glass, etc.) due to its gravitational motion when placed into the supporting's guide hole (FIG. 3*d*). The marking holder looks like a tube with big opening on the top part (FIG. 1*a*-3) and with a little opening on the bottom of the holder, the marker tip hole (FIG. 1*e*), wherein the bottom must be formed that the marker tip hole (FIG. 1*e*) is closer to the surface than the sides of the marking/pen holder tube, either visible from outside such as angled look, or from created from inside, it must let/guide easily marker/pen into the marker tip hole (FIG. 1*e*). The marking/pen holder tube's surface outside look is: smooth from the bottom (FIG. 1 *a*-2), and threaded from the smooth side to the rest of the top part (FIG. 1 *a*-1) allowing the nut/screw nut (FIG. 1*b*) for adjustments (FIG. 2.1) and (FIG. 2.2).

Referring to FIG. 2.1, wherein the said marking/pen holder tube (FIG. 2.1 *a*) is situated inside the supporting guide hole (FIG. 3*d*) and is in a higher position, wherein the threaded surface (FIG. 1 *a*-1) and in particular the top part is bigger/longer than if in lower position (FIG. 1 *a*-2). Predominantly the screw (FIG. 2.1 *b*) is the adjustment key allowing the marking/pen holder tube to be in said position. The screw is blocking the marking/pen holder tube against sliding through the supporting guide's hole downwards, wherein can easily slide the other direction/upwards; moreover, the marking/pen holder tube is not mounted to the supporting guide (FIG. 2.1 *c*) and the marking holder can be moved to a different hole (FIG. 3*d*).

Referring to FIG. 2.2, wherein the said marking/pen holder tube (FIG. 2.2 *a*) is situated inside the supporting guide hole (FIG. 3*d*) and is in a lower position, wherein the threaded surface (FIG. 1 *a*-1) and in particular the top part is smaller/shorter than if in higher/taller position (FIG. 1 *a*-2). Predominantly the screw (FIG. 2.2 *b*) is the adjustment key allowing the marking/pen holder tube to be in said/assigned position. The screw is blocking the marking/pen holder tube against sliding through the supporting guide's hole downwards, wherein can easily slide the other direction/upwards; moreover, the marking/pen holder tube is not mounted to the supporting guide (FIG. 2.2 *c*) and the marking/pen holder tube can be moved to a different hole (FIG. 3*d*). Moreover, when in lower position, and working on uneven surfaces (concrete, uneven wood surface, etc.) where the distance between supporting guide (FIG. 2.2 *c*) and surface (FIG. 2.2 *f*) will become shorter than the inputted marking/pen holder tube adjusted with nut/screw (FIG. 2.2 *b*), and because the marking holder is not mounted it moves/slides upwards allowing the marking/pen holder tube to move without any restrictions upwards (as if it was dissembled), but when the surface suddenly becomes larger, the gravity will bring the marking/pen holder tube down to the surface to touch the surface accordingly (FIG. 2.2 *e*); therefore, every surface is touched by the marking object to acquire noticeable contour lines for an easy and convenient cut.

What is claimed is:

1. A marking system using gravity, comprising:

a) a supporting guide comprising a track with at least one vertical hole having an inner diameter to secure storage of a marking assembly;

b) said marking assembly comprising:

1) a cylindrical marking object holder tube having an outer surface comprising a smooth surface adjacent a bottom end and a threaded surface adjacent a top end; said tube having a generally constant diameter, from the bottom end to the top end, smaller than the diameter of the at least one vertical hole such that the tube is configured to slide freely within the at least one hole; wherein said tube is hollow with a first opening at the top end to input a marking object and a second, smaller opening at the bottom end configured to allow a tip of the marking object to extend beyond the tube;

2) a nut threaded onto said threaded surface of said tube that has a diameter greater than the diameter of the at least one vertical hole to limit downward movement of the assembly and to adjust the tube's position within said at least one vertical hole.

2. The marking system of claim 1, wherein said marking assembly has a significant weight such that when said marking assembly is positioned on a working surface and said tube is located inside the at least one vertical hole, the height of the tube can be adjusted by manipulating the nut; wherein said tube is a carriage for any marker that is compatible with a working surface; wherein said tube lets out a tip of said marking object to touch/mark a surface, wherein a working surface can be uneven allowing said tube to slide vertically accordingly to said surface and slide downwardly using gravity to mark a surface, the vertical movement limited by the location of the nut.

3. The marking system of claim 1, wherein the said system may be operated manually, and/or mechanically, and/or automatically, and/or electronically.

* * * * *